US006377222B1

(12) United States Patent
Nicholson

(10) Patent No.: US 6,377,222 B1
(45) Date of Patent: Apr. 23, 2002

(54) ORNAMENTAL ANTENNA LIGHT

(75) Inventor: Michele Nicholson, New York, NY (US)

(73) Assignee: A. Aronson, Inc., New York, NY (US)

( * ) Notice: Subject to any disclaimer, the term of this patent is extended or adjusted under 35 U.S.C. 154(b) by 0 days.

(21) Appl. No.: 09/666,785

(22) Filed: Sep. 21, 2000

Related U.S. Application Data

(60) Provisional application No. 60/155,079, filed on Sep. 21, 1999.

(51) Int. Cl.[7] ..... H01Q 1/06
(52) U.S. Cl. ..... 343/713; 343/721
(58) Field of Search ..... 343/713, 721, 343/894, 720, 760; 116/209

(56) References Cited

U.S. PATENT DOCUMENTS 4,020,335 A * 4/1977 Bisceglia ..... 240/7.1 R
4,100,547 A 7/1978 Cooke ..... 343/721
4,110,818 A 8/1978 Hempsey ..... 362/32
5,357,361 A * 10/1994 Nishizawa ..... 359/142
5,448,456 A 9/1995 Huynh ..... 362/80
5,836,261 A * 11/1998 Sutton ..... 116/209

* cited by examiner

*Primary Examiner*—Don Wong
*Assistant Examiner*—James Clinger
(74) *Attorney, Agent, or Firm*—Anthony J. Casella; Gerald E. Hespos

(57) ABSTRACT

An ornamental antenna light is provided to be placed on an automobile antenna to decorate one's automobile or to identify the automobile to its owner. The light includes a particular configuration of molded plastic, a lighting mechanism, and a retaining means for retaining the light assembly onto the automobile's antenna. The configuration of molded plastic can be in different sizes, shapes, and colors to correspond to different designs, characters, and insignias. The molded plastic is preferably of the transparent or translucent type, so that when the internal lighting mechanism is activated, light shall be capable of passing through the plastic. The lighting mechanism is simple electrical circuit comprising a battery, an on/off switch, and a light bulb, all wholly contained within the configuration of molded plastic thus eliminating a need for an external light and power source. The retaining means comprises a locking switch and spring to positively engage the automobile's antenna.

9 Claims, 2 Drawing Sheets

ORNAMENTAL ANTENNA LIGHT

CROSS-REFERENCE TO RELATED APPLICATION

This application is based on U.S. Provisional Patent Application, U.S. Serial No. 60/155,079, which was filed Sep. 21, 1999 and is entitled "ORNAMENTAL ANTENNA LIGHT", the disclosure of which is incorporated herein by reference.

BACKGROUND OF THE INVENTION

1. Field of the Invention

The subject invention relates to an ornamental light, and more particularly to an ornamental antenna light to be placed on an automobile antenna to decorate one's automobile or to identify the automobile to its owner.

2. Description of the Related Art

Currently, automobile antennae function to receive radio signals, which in turn are transformed into sound energy transmitted through an automobile's sound system. These antennae are elongated metal rods and may be retractable into the automobile when not in use. When fully extended, the free end of the antenna, which defines its highest point, is usually located at a distance from the ground higher than any other height of the automobile. The antennae usually serve no other purpose than to receive radio signals.

Others in the prior art have ted to find another useful function for a vehicle antenna. Once such example is disclosed in U.S. Pat. No. 4,110,818 issued to Raymond Hempsey on Aug. 29, 1978. Hempsey discloses an illuminated flag or pennant adapted to be affixed to the radio antenna of a moving vehicle, such as boat or automobile, to display the vehicle operators call letters or handle. However, the flag or pennant of Hempsey is a complicated structure where the indicia of the flag is composed by individual strands of a fiber optic cable which requires an external light and corresponding power source to illuminate the indicia. Also, a plurality of supports are required to secure the flag and fiber optic cable to the antenna.

The subject invention of an ornamental antenna light provides a new use for the otherwise rod of metal sticking out of an automobile The subject invention is a type of ornament that is placed on top of an automobile antenna, and may serve a decorative function by displaying a corporate trademark, a sporting team logo or seasonal holiday symbol. It may also serve an identification function as to facilitate finding an automobile in a large parking facility, where an automobile owner may need to identify his or her automobile out of a field of hundreds of automobiles.

It is an object of the subject invention to provide an ornamental antenna light which adds a decorative touch to an otherwise unattractive antenna.

It is another object of the subject invention to provide an ornamental antenna light which identifies the vehicle it is place upon to t he vehicle's owner.

Another object of the subject invention is to provide an ornamental antenna light which can easily be installed or removed from a vehicle's antenna in one step.

It is a further object o f the subject invention to provide an ornamental antenna light which does not require an external power source.

SUMMARY OF THE INVENTION

The above stated objects are met by a new ornamental light and more particularly an ornamental antenna light to be placed on the top of an automobile's antenna. The light assembly includes a particular configuration of molded plastic, a lighting mechanism, and a retaining means for retaining the light assembly onto the automobile's antenna. The configuration of molded plastic can be in different sizes, shapes, and colors to correspond to different designs, characters or insignias. The molded plastic is preferably of the transparent or translucent type, so that when the internal lighting mechanism is activated, light shall be capable of passing the though the plastic. The molded plastic can also be made of a "glow-in-the-dark" material to enhance the illumination of the device in conjunction with the internal lighting mechanism or to be the only illumination means when no internal lighting mechanism is employed.

A particular configuration of molded plastic in accordance with the subject invention is hollow so that the entire lighting mechanism may be placed inside the molded plastic to illuminate it. The lighting mechanism is a simple electrical circuit comprising a battery, an on-off switch, and a light bulb. The light bulb may be a low wattage bulb or a light emitting diode (LED) which requires only a small power source. Preferably, the power source is a small Lithium battery approximately the size of a dime, comparable to those used in wrist watches and hearing aids. By using components of this nature, the lighting mechanism and power source can be contained within the molded plastic thus eliminating a need for an external light and power source.

In use, the ornamental antenna light of the subject invention is placed on an automobile's antenna and held to such by a retaining means. In its simplest form, the retaining means would include a cylindrically shaped tube with one end closed. The cylindrically shaped tube is disposed within the configuration of molded plastic such that the open end of the tube is aligned with a circular aperture in the molded plastic to define an insert area, in which, the automobile antenna may be inserted. The tube is filled with a spongy material which expands and contracts to accommodate different size diameter antennae. When the ornamented light assembly is placed on an automobile antenna, the spongy material inside the cylindrically shaped tube conforms to the automobile antenna, thereby firmly holding the assembly in place.

In a preferred embodiment, the retaining means will comprise a locking switch and spring to positively engage the antenna. The locking switch comprises an aperture equal in size to the aperture in the molded configuration. In its normal state, the spring forces the locking switch to one side of the configuration causing the aperture of the locking switch and the aperture of the molded configuration to misalign. When actuated, the locking switch causes the spring to compress and allows the apertures of the locking switch and molded configuration to align. When aligned, the ornamental antenna light can be placed over the automobile's antenna until the top of the antenna comes into contact with the top of the assembly. Once in place, the spring attempts to move the locking switch back to its normal state thus causing opposing sides of each aperture to engage the antenna. The retaining means comprising the locking block and spring can also be configured so when actuated, it in turn can activate the on/off switch of the lighting mechanism and illuminate the assembly. Therefore, with a simple press of the retaining means plunger, a user can install and illuminate the ornamental antenna light in one step.

In use as a decorative accessory for an automobile, the ornamental antenna light of the subject invention can take on many configurations. Once such configuration can be any seasonal holiday symbol, for example, a Christmas tree star, snowman, or reindeer for Christmas, or a ghost or pumpkin for Halloween. The configuration of the subject invention could also be a cartoon character derived from animated stories, corporate logos or trademarks or sporting team mascots.

Beside its decorative function, the ornamental antenna light can serve as an identification means for distinguishing one's automobile. When parking at a large public facility such as a shopping mall or sporting venue, a vehicle owner might find themselves parking their automobile among hundreds or thousands of other automobiles. Since the ornamental antenna light would be mounted on top of an antenna which usually extends higher than any other point of the automobile, the ornamental antenna light will serve as an identification means for an owner while roaming down the aisles of a parking lot trying to find their vehicle.

These and other features of the present invention will become apparent from the following detailed description considered in connection with the accompanying drawings. It should be understood, however, that the drawings are designed for the purpose of illustration only and not as a definition of the limits of the invention.

DETAILED DESCRIPTION OF THE INVENTION

Figure 1:
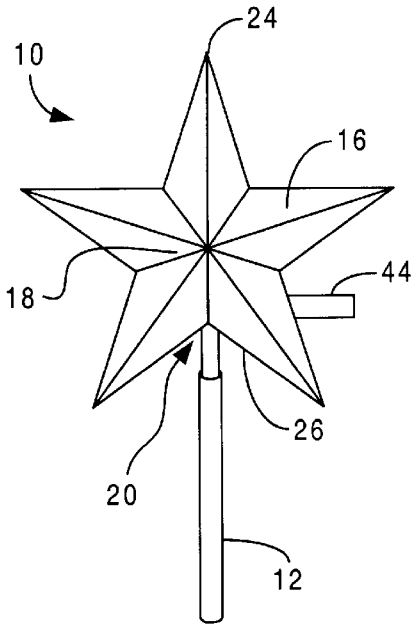
FIG. 1 is a perspective view of the ornamental antenna light of the subject invention.
Figure 3:
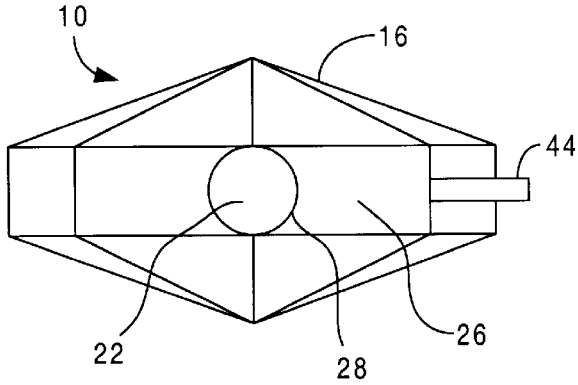
FIG. 3 is a bottom plan view of the ornamental antenna light of the subject invention.
Figure 2:
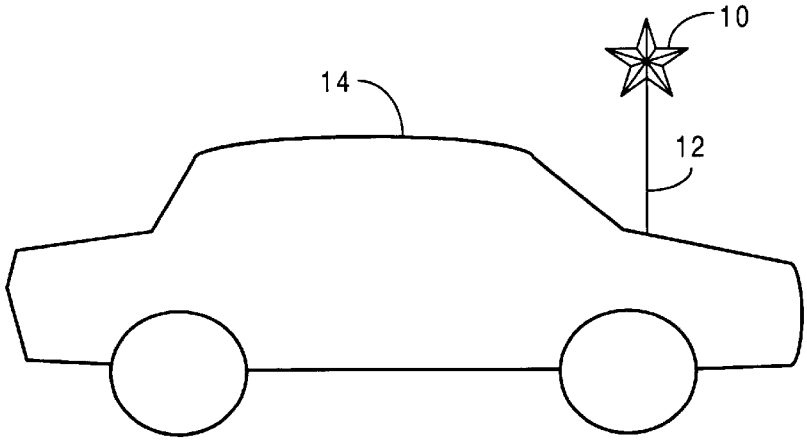
FIG. 2 is a perspective view of the ornamental antenna light of the subject invention mounted on an automobile's antenna.
Figure 4:
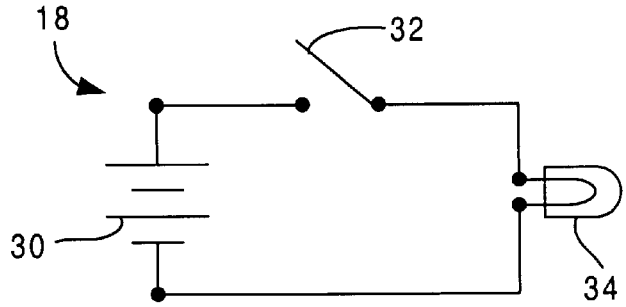
FIG. 4 is a schematic circuit diagram of the lighting mechanism in accordance with the ornamental antenna light of the subject invention.

Referring to FIGS. 1–3, the ornamental antenna light of the subject invention is generally indicated by the reference numeral 10. As shown in use, the assembly 10 of the subject invention is to be placed on an antenna 12 of an automobile 14. The ornamental antenna light 10 is assembled from a particular configuration of molded plastic 16, a lighting mechanism 18, and a retaining means 20 for retaining the light assembly 10 onto the automobile's antenna 12. The configuration of molded plastic 16 can be in different sizes, shapes, and colors to correspond to different designs, characters, or insignias. As an illustrative example of the subject invention, a configuration of molded plastic in the shape of a five-pointed star will be shown and discussed.

The configuration of molded plastic 16 will generally be formed from two parts, which are substantially mirror images of each other. When the two parts are assembled, the configuration defines a hollow cavity 22, a top surface 24 and bottom surface 26. The bottom surface 26 will be formed to include an aperture 28 which will define an insert area for the automobile's antenna 12. The molded plastic 16 is preferably of the transparent or translucent type, so that when the lighting mechanism 18 is disposed within the cavity 22, light shall be capable of passing through the plastic. The molded plastic 16 can also be made of a "glow-in-the-dark" material to enhance the illumination of the assembly 10 in conjunction with the internal lighting mechanism 18 or to be the only illumination means when no internal lighting mechanism 18 is employed.

Regardless of the particular configuration of molded plastic 16, the cavity 22 formed within shall be large enough so that the entire lighting mechanism 18 may be placed inside the molded plastic 16 to illuminated. The lighting mechanism 16 is a simple electrical circuit comprising a battery 30, and on/off switch 32, and a light bulb 34. The light bulb 34 may be a low wattage bulb or a light emitting diode (LED) which requires only a small power source. Preferably the power source 30 is a small lithium battery approximately the size of a dime, comparable to those used in wrist watches and hearing aids. By using components of this nature and size, the lighting mechanism 18 and power source 30 can be completely contained within the molded plastic 16 thus eliminating a need for an external light and power source.

In use, the ornamental antenna light 10 of the subject invention is placed on an automobile's antenna 12 and held to such by a retaining means 20. In its simplest form, the retaining means 20 will include a cylindrically shaped tube with one end closed. This cylindrically shaped tube will then be disposed within the cavity 22 of the configuration of molded plastic 16 such that the open end of the tube is aligned with the circular aperture 28 of the bottom surface 26 to define an insert area in which the automobile antenna 12 may be inserted. The tube is filled with a spongy material which expands and contracts to accommodate different size diameter antennae. When the ornamental light assembly 10 is placed on an automobile's antenna 12, the spongy material inside the cylindrically shaped tube conforms to the automobile antenna 12, thereby firmly holding the assembly 10 in place.

Figure 5:
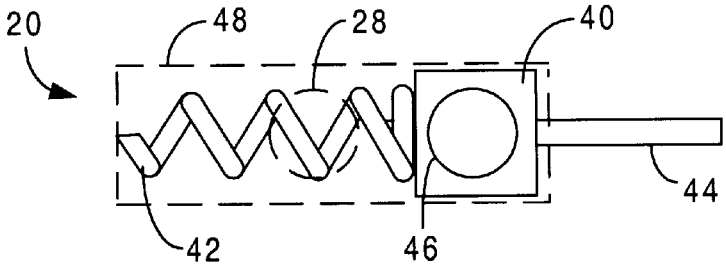
FIG. 5 is a schematic diagram of the retaining means in accordance with the subject invention in its normal state.
Figure 6:
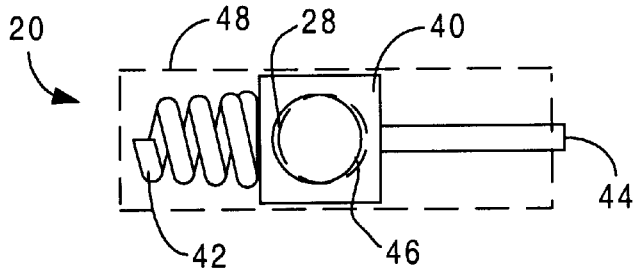
FIG. 6 is a schematic diagram of the retaining means in accordance with the subject invention where the locking switch has been actuated to align the apertures of the locking switch and molded plastic to prepared the ornamental antenna light for mounting.
Figure 7:
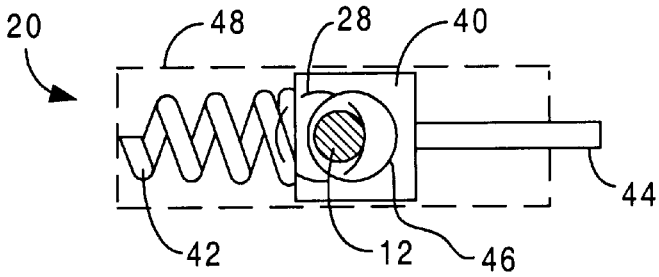
FIG. 7 is a schematic diagram of the retaining means in accordance with the subject invention where the aperture of the locking switch and aperture of the molded plastic have engaged the automobile's antenna.

In a preferred embodiment, the retaining means 20 will comprise a locking switch 40 and a spring 42 to positively engage the antenna 12. The locking switch 40 comprises a plunger 44 which extends through the configuration of molded plastic 16 so that the retaining means can be actuated by a user. The locking switch 40 also comprises an aperture 46 equal in size to the aperture 28 in the molded configuration. The retaining means 20 will be disposed within the cavity 22 of the molded configuration 16 in close proximity to the bottom surface 26. The locking switch 40 and spring 42 of the retaining means 20 will be retained within the cavity 22 by a guide 48 formed from molded plastic. In its normal state as shown in FIG. 5, the spring 42 forces the locking switch 40 to one side of the configuration causing the aperture 46 of the locking switch 40 and the aperture 28 of the molded configuration 16 to misalign. When the retaining means is actuated by pressing against the plunger 44, the locking switch 40 causes the spring 42 to compress and allows the apertures 28, 46 of the locking switch and molded configuration to align. As shown in FIG. 6 when the apertures are aligned, the ornamental antenna light 10 can be placed over the automobile's antenna 12 until the top of the antenna 12 comes into contact with the top of the assembly 24. Once in place as shown in FIG. 7, the spring 42 attempts to move the locking switch 40 back to its normal state thus causing opposing sides of each aperture to engage the antenna 12, thus firmly holding the assembly 10 in place.

The retaining means 20 can also be configured so when actuated the locking block 40 can come into contact with the on/off switch 32 causing the lighting mechanism 18 to illuminate the assembly. In this configuration, the light will stay illuminated until the retaining means returns to its normal state. Therefore, with a simple press of the retaining means plunger 44, a user can install an illuminate the ornamental antenna light 10 in one step.

As is readily apparent, numerous modifications and changes may readily occur to those skilled in the art, and hence, it is not desired to limit the invention to the exact construction and operation as shown and described, and, accordingly, all suitable modification equivalents may be resorted to falling within the scope of the invention as claimed.

What is claimed is:

1. An ornamental antenna light to be removably secured to an automobile's antenna, said ornamental antenna light comprising:

a configuration formed of molded plastic to define a cavity, said configuration formed with a top surface and a bottom surface, with said bottom surface including an aperture to define an insert area for said automobile antenna;

a lighting mechanism disposed within said cavity of said configuration;

an elongated, tubular guide fixed in said configuration and extending perpendicular to the longitudinal axis of the aperture, said guide including two holes aligned with said aperture's longitudinal axis; and retaining means disposed within said guide for firmly holding said ornamental antenna light on said antenna, said retaining means including a spring biased locking switch with an opening extending therethrough, said retaining means further including a plunger connected to said locking switch and extending through the configuration, whereby when said plunger is depressed, the opening of the locking switch, said aperture of the configuration and the holes in the guide are aligned to permit the antenna to extend into the configuration and when the plunger is released, the spring biases the locking switch to engage and hold the antenna in position.

2. An ornamental antenna light as in claim 1, wherein said configuration is formed from transparent or translucent plastic.

3. An ornamental antenna light as in claim 1, wherein said configuration is formed from a glow-in-the-dark material.

4. An ornamental antenna light as in claim 1, wherein said lighting mechanism further comprises a battery, an on/off switch and a light bulb.

5. An ornamental antenna light as in claim 4, wherein said light bulb is a light emitting diode (LED).

6. An ornamental antenna light as in claim 4, wherein said battery is a lithium battery.

7. An ornamental antenna light as in claim 1, wherein said retaining means further comprises a cylindrically shaped tube formed with a closed end and an open end, said tube being disposed within said cavity of said configuration such that the tube is perpendicular to the bottom surface of the molded plastic and the open end is aligned with said aperture of said bottom surface of said configuration.

8. An ornamental antenna light as in claim 1, wherein said retaining means is positioned in close proximity to said bottom surface of said configuration.

9. An ornamental antenna light as in claim 1, wherein said retaining means is positioned to come into contact with said on/off switch of said lighting mechanism whereby when the retaining means is actuated said on/off switch closes to illuminate said light.

* * * * *